US007810525B2

(12) United States Patent
Schneider et al.

(10) Patent No.: US 7,810,525 B2
(45) Date of Patent: Oct. 12, 2010

(54) TRIMMING STRIP FOR THE SHAPING OF CIGARETTES AND/OR FILTERS

(75) Inventors: Manfred Schneider, Herbrechtingen (DE); Gerhard Beckh, Herbrechtingen (DE)

(73) Assignee: Max Schlatterer GmbH & Co. KG (DE)

( * ) Notice: Subject to any disclaimer, the term of this patent is extended or adjusted under 35 U.S.C. 154(b) by 0 days.

(21) Appl. No.: 12/281,308

(22) PCT Filed: Mar. 27, 2007

(86) PCT No.: PCT/EP2007/002670

§ 371 (c)(1), (2), (4) Date: Dec. 11, 2008

(87) PCT Pub. No.: WO2007/115674

PCT Pub. Date: Oct. 18, 2007

(65) Prior Publication Data

US 2009/0165884 A1 Jul. 2, 2009

(30) Foreign Application Priority Data

Apr. 3, 2006 (DE) ..... 10 2006 015 848

(51) Int. Cl.
*D03D 15/08* (2006.01)
*D03D 1/00* (2006.01)
*D03D 25/00* (2006.01)

(52) U.S. Cl. ..... 139/383 R; 139/420 R; 139/424; 139/426 R; 139/420 A

(58) Field of Classification Search ..... 139/383 R, 139/420 R, 424, 426 R, 420 A
See application file for complete search history.

(56) References Cited

U.S. PATENT DOCUMENTS

| | | | | | |
|---|---|---|---|---|---|
| 3,013,901 | A * | 12/1961 | Bugosh | 442/136 |
| 3,983,761 | A * | 10/1976 | Stewart | 198/846 |
| 4,159,360 | A * | 6/1979 | Kim | 428/195.1 |
| 4,900,613 | A * | 2/1990 | Green | 442/189 |
| 4,977,017 | A * | 12/1990 | Schneider | 442/214 |
| 6,668,868 | B2 * | 12/2003 | Howland et al. | 139/383 R |
| 6,689,517 | B1 * | 2/2004 | Kaminsky et al. | 430/11 |
| 2005/0035057 | A1 * | 2/2005 | Zikeli et al. | 210/602 |

FOREIGN PATENT DOCUMENTS

| | | |
|---|---|---|
| DE | 1 106 031 | 11/1955 |
| DE | 26 40 949 | 9/1976 |
| DE | 37 42 183 | 4/1989 |
| DE | 199 48 977 | 10/1999 |
| DE | 696 14 403 | 10/2007 |

OTHER PUBLICATIONS

Franz Fourne, Synthetische Fasern Herstellung, Maschinen und Apparate, Eigenschaften Hansbuch fur Anlagebplanung, Maschinenkonstruktion und Betrieb. 1995 Carl Hanser Verlag Munchen Wien.

* cited by examiner

*Primary Examiner*—Bobby H Muromoto, Jr.
(74) *Attorney, Agent, or Firm*—Wells ST. John PS

(57) ABSTRACT

A garniture tape for forming cigarettes and/or filters. The garniture tape having at least one warp thread and having a plurality of weft threads. The at least one warp thread has at least one liquid crystal polymer thread and at least one further thread which has greater roughness than the liquid crystal polymer thread.

19 Claims, 1 Drawing Sheet

TRIMMING STRIP FOR THE SHAPING OF CIGARETTES AND/OR FILTERS

CROSS REFERENCE TO RELATED APPLICATION

Figure 1:
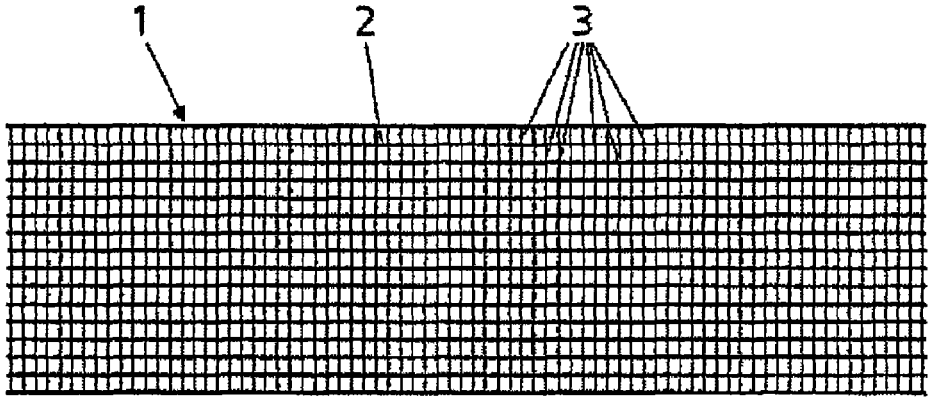

This is a 35 U.S.C. 35 U.S.C. §371 application and claims priority to PCT International Application No. PCT/EP2007/002670, which was filed Mar. 27, 2007, and which claims priority to German Patent Application No. 10 2006 015 848.2, which was filed Apr. 3, 2006, and the teachings of all the applications are incorporated herein by reference.

This invention relates to a garniture tape for forming cigarettes and/or filters, having at least one warp thread and having a plurality of weft threads.

DE 37 42 183 C1 discloses a garniture tape of the type in question. Such a woven fabric tape, usually configured as an endless tape, is produced by winding a thread into a thread helix whose diameter determines the length of the final tape, whereas the width of the tape is determined by the number of windings. As usual, introducing the weft threads joins up the thread helix and waves it up to form a homogeneous endless tape.

Particularly when such tapes are used as a garniture tape for forming cigarettes and/or filters, very high quality requirements have to be met, to the effect that production at the very high rates of up to 20 000 cigarettes per minute requires a tape which is completely invariant in its properties at least during a shift of typically about 8 hours.

The garniture tape known from DE 37 42 183 C1, which utilizes natural and aramid fibers, has proved to be less than ideal for this purpose, since specifically the natural fibers are not sufficiently stable at the high attainable productivities. Particularly the influence of the heat of friction at such high speeds leads to a reduction in the strength of the tape and thus to a sometimes appreciable stretching thereof, which necessitates frequent tape changes. The running properties of the tape also change in this context, they may result in a side-to-side wobble which in turn leads to diameter fluctuations on the part of the cigarette produced, to an uneven overlap of the glue seam and in some instances even to creases and/or marks on the cigarettes.

Furthermore, the constantly changing bending force acting on the tape has the effect that the long-chain molecules in the aramid fibers, owing to their high crystallinity, tend to break on being subjected to a mechanical stress, in particular at comparatively high bending frequencies, so that the requisite quality can no longer be produced after a very short time. This necessitates even more frequent prophylactic tape changes, since the rupturing of such a tape leads to very high costs due to the associated production outage.

DE 199 48 977 A1 discloses a polymer composition comprising, inter alia, an aromatic, liquid-crystalline polyester and useful for producing monofilaments which in turn are processed into fabrics, in particular industrial wovens.

DE 696 14 403 T2 describes composite yarns having high cut resistance for severe service, in particular for making protective gloves for meat cutting or the handling of metal and glass sheets. The composite yarn comprises a high modulus fiber and a particle-filled fiber comprising a semi-crystalline polymer and hard particles.

It is an object of the present invention to provide a garniture tape for forming cigarettes and/or filters which retains its performance characteristics for a long time, even under high mechanical loading and high temperatures.

We have found that this object is achieved according to the invention by the features in claim 1.

We have determined that, surprisingly, a warp thread comprising at least one liquid crystal polymer thread and at least one further thread endows the garniture tape of the present invention with very high strength, so that the garniture tape of the present invention has a longer service life and hence can be used for a very much longer period than prior art tapes. This means that the user of the garniture tape of the present invention is able to earn back a possibly higher cost of purchase within a very short period.

A further advantage of the garniture tape of the present invention is that it has an appreciably lower tendency to rupture or otherwise fail and so there is a very much higher consistency when it is used and production outages are unlikely. Particularly in relation, to bending stresses, the liquid crystal polymer thread will prove to be extremely suitable.

The at least one further thread serves to render the garniture tape of the present invention suitable for transportation purposes, since the liquid crystal polymer thread typically has insufficient roughness for this purpose. Therefore, the at least one further thread should be made of a material having greater roughness than the liquid crystal polymer thread.

It is a further advantage of the garniture tape of the present invention that it complies with all requirements of the food industry and of the tobacco regulations.

A polyester fiber will prove to be a particularly suitable material for the liquid crystal polymer thread of the warp thread.

To be able to meet the high requirements placed on the garniture tape of the present invention, it is particularly advantageous when the at least one further thread of the warp thread consists of a synthetic material.

Particularly polyvinyl alcohol will prove useful as synthetic material for the at least one further thread of the warp thread.

To achieve a stiff, linear and parallel molecular structure for the molecules, the at least one liquid crystal polymer thread of the warp thread may be produced by a melt-spinning process.

Depending on the particular use planned for the garniture tape, the quantitative ratio of the liquid crystal polymer thread to the at least one further thread can be between 1:1 and 1:4.

To achieve a high strength for the warp thread, the individual threads of the at least one warp thread may be twisted together.

The roughness required for the warp thread can be achieved in particular when the at least one further thread of the warp thread is produced in a stretch break process. As a result, the spun, at least one further thread acquires a textile character and is very useful for transporting cigarette or filter paper for example. Furthermore, the at least one further thread thereby offers mechanical protection to the liquid crystal polymer thread.

Figure 2:
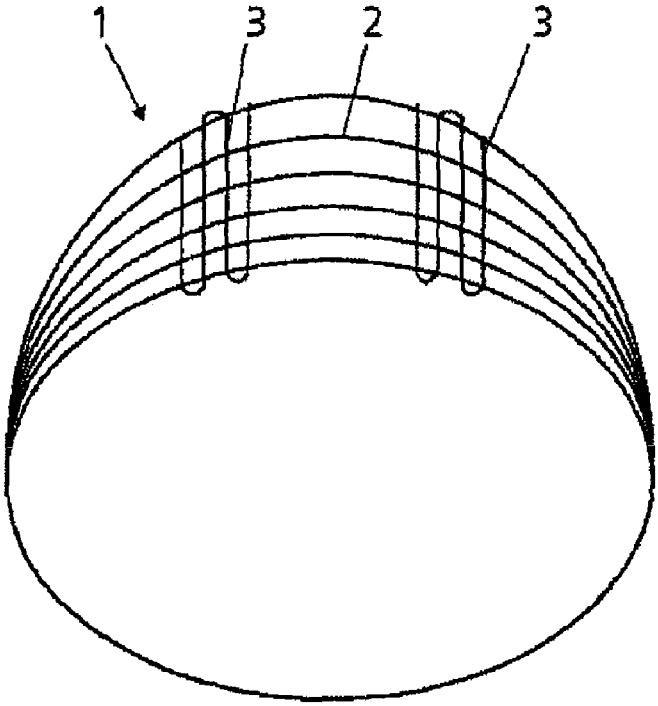
Figure 3:
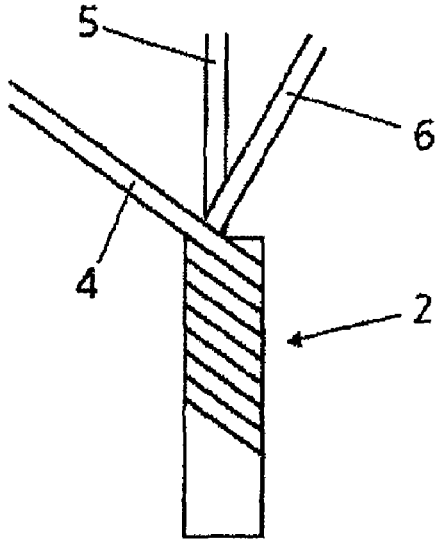

Further advantageous elaborations and developments of the present invention will be apparent from the remaining subclaims. An illustrative embodiment of the present invention will now be described in principle with reference to the drawing, where FIG. 1 shows a plan view of a garniture tape of the present invention;

FIG. 2 shows a perspective view of the garniture tape of the present invention; and FIG. 3 shows the construction of a warp thread of the garniture tape of the present invention.

FIG. 1 shows a garniture tape 1 for forming cigarettes and/or filters (not shown). The garniture tape 1 comprises a warp thread 2 having a plurality of loops and a plurality of weft threads 3 which join the individual loops of the warp thread 2 together in a conventional manner to form a homogeneous endless tape. The machine in which the garniture tape 1 is used can be of conventional design and therefore is not shown. During operation of the machine, the garniture tape 1 can be operated at speeds of up to 600 m/min, although this speed may possibly be even exceeded with the garniture tape 1 described in detail in what follows.

The drawing as per FIG. 2 reveals that the warp thread 2 is wound in the form of a helix in which the diameter of a loop or helical winding of the warp thread 2 determines the length of the endless garniture tape 1, while the number of windings determines its width. The garniture tape 1 can for example have a length of about 3 m and a width of about 20 mm. It will be appreciated, however, that the garniture tape 1 may have other dimensions, adapted to the particular planned use.

FIG. 3 shows the warp thread 2 in magnified form. The warp thread 2 comprises a liquid crystal polymer (LCP) thread 4 and two further threads 5 and 6 which consist of a synthetic material, in particular polyvinyl alcohol (PVA). Cotton, viscose, Kermel, PEEK or polyester could also be used for the threads 5 and/or 6 instead of polyvinyl alcohol. Thread 4 and also the two threads 5 and 6 thus consist of particularly heat-impervious materials and therefore even prolonged use of the garniture tape 1 does not lead to significant deteriorations in the properties thereof. The material used for thread 4 makes by virtue of its good mechanical properties a significant contribution to the strength of the entire warp thread 2.

With regard to the requirements of warp thread 2, which are further elucidated herein below, it will also prove very useful for the thread 5 to consist of polyvinyl alcohol and for the thread 6 to consist of linen. It is also possible to make both the threads 5 and 6 of linen. If appropriate, there could also be more than the two further threads 5 and 6 and therefore the warp thread 2 could thus altogether have four or more threads.

To produce the liquid crystal polymer thread 4 it is preferable to use a continuous filament polyester fiber produced by a melt-spinning process. By contrast, the further threads 5 and 6 of the warp thread 2 are produced in a stretch break process. Stretch-breaking the initially continuous filament fibers results in a staple length of about 45 to about 250 mm. The coefficient of friction between the cigarette or filter paper to be transported and the garniture tape 1 should ideally not be below a value of $\mu=0.3$, and this is achieved by the threads 5 and 6. The liquid crystal polymer thread 4 could also be produced by means of such a stretch break process in order that its surface roughness may be increased.

In principle, the quantitative ratio of the liquid crystal polymer thread 4 to the at least one further thread 5/6 can be between 1:1 and 1:4; that is, when one thread 4 is used, between one and four can be used of the threads 5 and 6. FIG. 3 further reveals that the individual threads 4, 5 and 6 of the warp thread 2 are twisted together, the drawing showing the threads 4, 5 and 6 to be twisted together as equals, although it is also possible to twist one or more of the threads 5 and/or 6 around the LCP thread 4, so that the LCP thread 4 is not at the surface of the warp thread 2.

A two-stage twisting process is used to produce the warp thread 2. First the individual components are twisted in one direction in a first twisting operation and then the pretwisted materials are twisted together in the other direction to form the final twisted thread.

The weft thread 3 preferably consists of two materials, at least one component of one of the materials being selected from the group consisting of LCP fiber, aramid fiber, para-aramid fiber, poly(ether ketone) fiber, poly(ether ether ketone) fiber, novoloid fiber, polybenzimidazole fiber, poly (butylene terephthalate) fiber, poly(ethylene terephthalate) fiber and polyamide fiber. It may further be envisioned that individual components of the warp and/or weft threads 2 and/or 3 are wrapped by means of a core yarn spinning process.

What is claimed is:

1. A garniture tape for forming cigarettes and/or filters, comprising:

at least one warp thread;

a plurality of weft threads; and the at least one warp thread comprising at least one liquid crystal polymer thread and at least two further threads which have greater roughness than the liquid crystal polymer thread, the two further threads comprising a first thread and a second thread, the first thread comprising a first material and the second thread comprising a second material different from the first material.

2. The garniture tape according to claim 1, wherein the at least one liquid crystal polymer thread of the warp thread is produced by a melt-spinning process.

3. The garniture tape according to claim 1, wherein a quantitative ratio of the thread of liquid crystal polymer to the at least two further threads is between 1:2 and 1:4.

4. The garniture tape according to claim 1, characterized in that the at least one further thread of the warp thread is produced in a stretch break process.

5. The garniture tape according to claim 1, characterized in that the weft threads consist of at least two materials, at least one component of one of the materials being selected from the group consisting of LCP fiber, aramid fiber, para-aramid fiber, poly(ether ketone) fiber, poly(ether ether ketone) fiber, novoloid fiber, polybenzimidazole fiber, poly(butylene terephthalate) fiber, poly(ethylene terephthalate) fiber and polyamide fiber.

6. The garniture tape according to claim 1, characterized in that individual components of the warp and/or weft threads are wrapped by means of a core yarn spinning process.

7. The garniture tape according to claim 1, wherein the first material of the first thread comprises polyvinyl alcohol and wherein the second material of the second thread comprises at least one of the following materials: cotton, viscose, Kermel, PEEK and polyester.

8. The garniture tape according to claim 1, wherein the first material of the first thread comprises polyvinyl alcohol and wherein the second material of the second thread comprises at least one of the following materials: Kermel and PEEK.

9. The garniture tape according to claim 1, wherein the first material of the first thread comprises polyvinyl alcohol and wherein the second material of the second thread comprises linen.

10. The garniture tape according to claim 1, wherein the first material of the first thread comprises linen and wherein the second material of the second thread comprises at least one of the following materials: cotton, viscose, Kermel, PEEK and polyester.

11. The garniture tape according to claim 1, wherein the first material of the first thread comprises linen and wherein the second material of the second thread comprises at least one of the following materials: Kermel and PEEK.

12. A garniture tape for forming cigarettes and/or filters, comprising:

at least one warp thread;

a plurality of weft threads; and the at least one warp thread comprising at least one liquid crystal polymer thread and at least three further threads, the three further threads comprising a first thread, a second thread and a third thread, the first thread comprising a first material and the second thread comprising a second material different from the first material.

13. The garniture tape according to claim 12, wherein the first material of the first thread comprises polyvinyl alcohol and wherein the second material of the second thread comprises at least one of the following materials: cotton, viscose, Kermel, PEEK and polyester.

14. The garniture tape according to claim 12, wherein the first material of the first thread comprises polyvinyl alcohol and wherein the second material of the second thread comprises at least one of the following materials: Kermel and PEEK.

15. The garniture tape according to claim 12, wherein the first material of the first thread comprises polyvinyl alcohol and wherein the second material of the second thread comprises linen.

16. The garniture tape according to claim 12, wherein the first material of the first thread comprises linen and wherein the second material of the second thread comprises at least one of the following materials: cotton, viscose, Kermel, PEEK and polyester.

17. The garniture tape according to claim 12, wherein the first material of the first thread comprises linen and wherein the second material of the second thread comprises at least one of the following materials: Kermel and PEEK.

18. The garniture tape according to claim 12, wherein a quantitative ratio of the thread of liquid crystal polymer to the at least three further threads is between 1:3 and 1:4.

19. The garniture tape according to claim 12, wherein the at least three further threads comprises four or more threads.

* * * * *